United States Patent [19]

Bruhn et al.

[11] 4,340,207

[45] Jul. 20, 1982

[54] WASTE HEAT RECOVERY APPARATUS

[75] Inventors: Alfred Bruhn, East Chester, N.Y.; William Bernard, Winnetka, Ill.

[73] Assignee: Dravo Corporation, Pittsburgh, Pa.

[21] Appl. No.: 99,336

[22] Filed: Dec. 3, 1979

Related U.S. Application Data

[63] Continuation-in-part of Ser. No. 768,087, Feb. 14, 1977, abandoned.

[51] Int. Cl.[3] ..... F27B 1/22

[52] U.S. Cl. ..... 266/155; 266/159; 266/900; 165/104.11; 165/DIG. 12; 165/10

[58] Field of Search ..... 266/159, 155, 900; 237/56; 165/107, 104.11 A, DIG. 12, 10

[56] References Cited

U.S. PATENT DOCUMENTS

| | | | |
|---|---|---|---|
| 2,910,244 | 10/1959 | Payne | 237/56 |
| 3,258,204 | 6/1966 | Smith, Jr. | 237/56 |
| 3,479,021 | 11/1969 | Escher | 266/159 |
| 3,623,549 | 11/1971 | Smith, Jr. | 165/107 |

*Primary Examiner*—M. J. Andrews

*Attorney, Agent, or Firm*—Louis E. Marn; Elliot M. Olstein

[57] ABSTRACT

There is disclosed a process and apparatus for the recovery of heat from exhaust or waste gases having a temperature of from about 500° to about 2500° F. generated in a process operation cycling between an operational mode and in idling mode utilizing an intermediate heat transfer fluid to recover heat and to use all or a portion of such recovered heat, inter alia, in such process operation.

4 Claims, 1 Drawing Figure

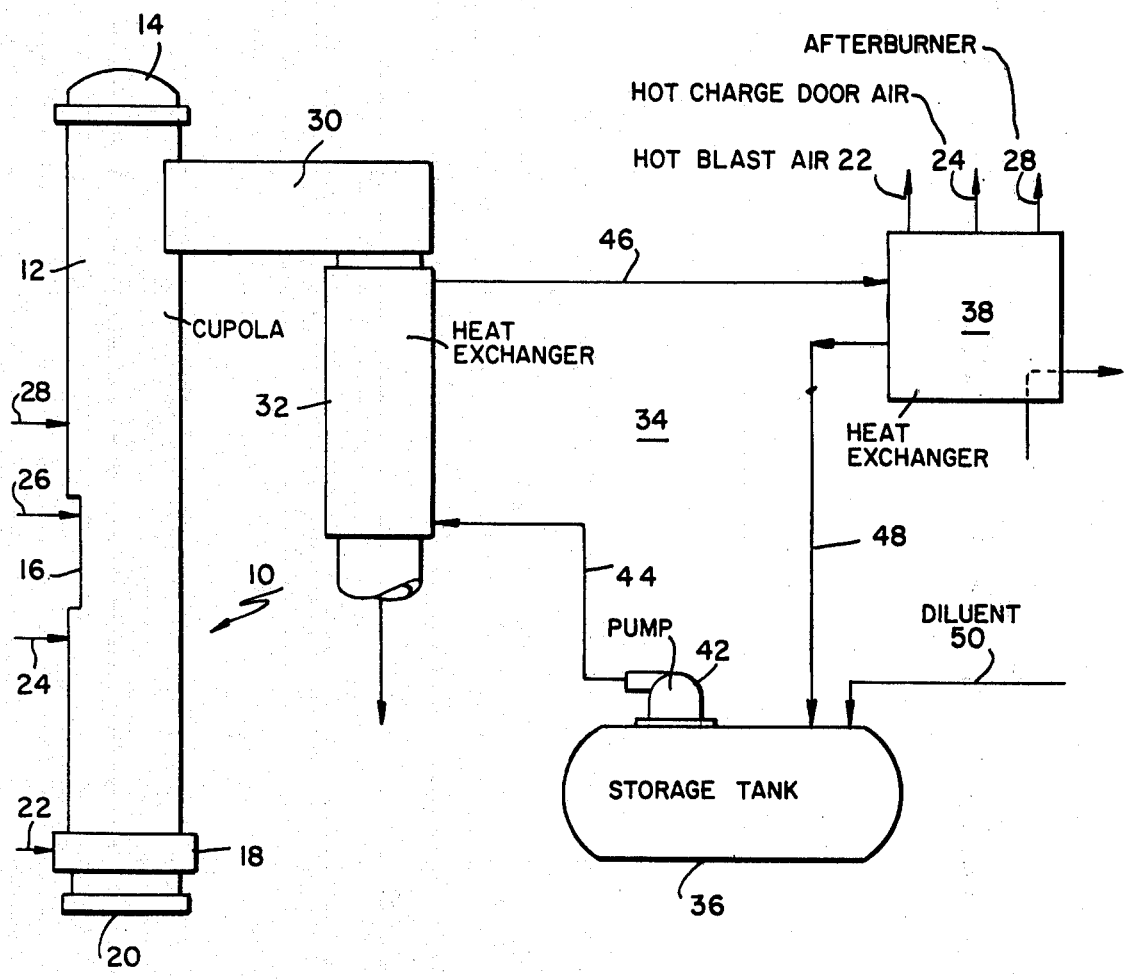
14
30
AFTERBURNER
HOT CHARGE DOOR AIR
HOT BLAST AIR 22
24
28
46
12
CUPOLA
HEAT EXCHANGER
38
28
32
34
HEAT EXCHANGER
26
48
16
10
44
PUMP
42
DILUENT 50
24
STORAGE TANK
22
18
36
20

WASTE HEAT RECOVERY APPARATUS

This is a continuation-in-part of U.S. application Ser. No. 768,087 filed Feb. 14, 1977, now abandoned.

BACKGROUND OF THE INVENTION

This invention relates to waste heat recovery, and more particularly to a process and apparatus for the recovery of heat from high temperature gases.

Heat exchange is an important aspect of essentially all process operations whether at high or low temperature processing conditions. Economics normally dictate effective utilization of heat transfer equipment with respect to processing streams. Waste heat recovery generally relates to the recovery of heat over and above basic heat requirements, e.g. in steam generation equipment, there are normally a convection section disposed in the equipment whereat the temperature level is insufficient for steam generation but at a level where sensible heat is available for heating duty, such as preheating water to be passed to a steam drum. There are some processing operations where heat is available for recovery, but is not effectively recovered, if at all, e.g., the operation of a cupola.

In a typical foundry operation, coke, limestone and a metallic portion, such as pig and scrap iron are introduced through a charge door into a cupola. Cold blast air is introduced through tuyeres in the bottom to provide the combustion medium for the coke. Additional air is induced through the charge door by an exhaust fan. Afterburners located above the charge door provide a source of ignition for carbon monoxide leaving the bed and for providing heat for the cupola when the cupola is not in production. Air entering the cupola in the form of blast air, charge door air, and afterburner air is normally cold and is heated to operating temperature by consuming coke in the lower portion of the cupola.

Hot gases at a temperature of from about 1800° to about 2200° F. during the melting operation are withdrawn from the top of the cupola and are generally passed to vertically disposed water scrubber wherein the gas is cooled to a temperature of from 400° to 500° F. prior to introduction into a solids collector, e.g. an electrostatic precipitator or bag house. With direct water cooling and scrubbing, a large quantity of steam is produced which increases the volume of gas through the downstream equipment.

Heat recovery systems have been installed in a small number of plants in the form of either a recuperative or regenerative type of heat recovery systems. With a recuperative type, expensive high alloy heat exchanger is employed to cool the hot gas by heating the blast air. This type of heat exchanger is very expensive due to the high alloy construction needed to withstand the high metal temperatures (1800° F. to 2200° F.) and the large amount of heat transfer surface as a result of the poor heat transfer coefficient of hot gas to cool air. The recuperative type is subject to mechanical failures due to the frequent wide swings in temperatures from 500° F.–2000° F. which can occur as much as 14 times a day with swings ranging from ambient to 2000° F. occurring with the daily startup and shutdown routine.

In the regenerative type, an expensive mesh wheel rotates and is alternately heated by hot gas and cooled by cool air. This type of heat exchanger is very large and is the source of much maintenance and plant shutdowns due to seal failures and corrosion where cold air condenses moisture and sulfur dioxide from the hot gas.

Both the recuperative and regenerative type of waste heat recovery systems effectively function only when the plant is at operating temperatures, i.e., 1800° to 2200° F. (gas temperature) and large amounts of blast air are needed. During idle time, when the afterburners are holding the cupola at around 500° to 1300° F. and no blast air is required, negligible heat is recovered. Idle time can amount to 8 hours per day or as much as 12 hours per day. Corresponding melting time would only be 8 hours or 4 hours with effective heat recovery time of 8 or 4 hours per day. Generally, such systems were limited to heat recovery necessary for preheating combustion air to reduce fuel requirements. Some process operations require gas fired auxiliary equipment since fuel oil firing produced a dirty or sooty exhaust gas which could not be tolerated by the process operation.

As briefly hereinabove indicated, heat exchangers have been used for various waste heat duty using the conventional heat transfer mediums. In U.S. Pat. No. 3,426,733, reference is made to the use of close looped systems for heat recovery utilizing heat transfer fluids, such as eutectic salt mixtures, aromatic heat transfer oils, tetrachlorobiphenyl compounds, and the like, however, indicating that such systems had inherent difficulties because such systems were closed loops. In U.S. Pat. No. 2,910,244, there is disclosed a process and apparatus for effecting an endothermic chemical reaction utilizing a molten salt mixture as an intermediate heat transfer medium.

OBJECTS OF THE INVENTION

An object of the present invention is to provide a novel process and apparatus for recovery system for a process operation from which a waste heat gas is withdrawn at elevated temperature.

Another object of the present invention is to provide for a novel heat recovery system for a process operation operating at elevated temperatures and having operational and standby modes of varying time durations.

Still another object of the present invention is to provide for a novel heat recovery system for recovering heat from a high temperature gas.

A still further object of the present invention is to provide a novel heat recovery system.

SUMMARY OF THE INVENTION

These and other objects of the present invention are achieved by a heat exchange system utilizing an intermediate heat transfer fluid which is a liquid at the operational temperature, such as eutectic salt systems, heat transfer oils or water for a process operation cycling between an operational mode and an idling mode, such as the operation of a cupola in which there is produced an exhaust or waste gas at temperatures of from 500° to 2500° F. Using such a system, the heat exchanger unit therefor may be fabricated using conventional materials of construction vice more expensive, high alloys materials of construction.

BRIEF DESCRIPTION OF THE DRAWING

The invention will be more clearly understood by reference to the following description of an exemplary embodiment thereof in conjunction with the accompanying drawing illustrating a schematic flow diagram.

DETAILED DESCRIPTION

Referring to the drawing, there is illustrated a cylindrical shaped cupola, generally indicated as 10, comprised of a vessel 12 provided with an upper hemispherically cover 14, a charge door 16, a tuyere 18, and a molten iron draw-off assembly, generally indicated as 20. The vessel 12 is provided with hot blast air line 22, hot charge door air line 24, charge door open to the outside by line 26 and an afterburner line 28. The upper portion of the vessel 12 is provided with a cross over duct 30 in fluid communication with a heat exchanger 32 of the heat recovery system, generally indicated as 34.

The heat recovery system 34 also includes a heat transfer fluid tank 36 and heat user equipment 38. The tank 36 is in fluid communication with the suction side of a pump 42 mounted on the tank 36 with the downstream side thereof being in fluid communication by conduit 44 with the tube or shell side of heat exchanger 32. The outlet from the liquid side of heat exchanger 32 is in fluid communication by conduit 46 with the heat user system 38 which in turn is in fluid flow communication by conduit 48. The tank 36 is provided with a conduit 50 for shutdown operation, as more fully hereinafter described. As hereinabove indicated, the heat user equipment includes gas heat exchangers for preheating the gases flowing in lines 22, 24, and 28, steam generating equipment for space heating duty or steam turbine utilization for the generation of electricity or compressing gaseous refrigerants.

In operation the heat recovery system 34, with its intermediate heat fluid is used to recover heat from the hot gas, store the heat during the cyclic operation of melting and idling, and utilize the heat in a variety of ways including heating the blast air, burner air, and charging door air; and generating steam in a heat transfer fluid to steam generation heat exchanger.

In the winter, the heat transfer fluid temperature can be set at a minimum to recover the maximum amount of heat with generated steam being used for space heating in the plant or adjacent offices and residences. In the summer, the fluid temperature can be set at a maximum for preheating blast air, burner air, and charging door air, and for generating electricity in a standard steam turbine-electric generator for driving plant motors or air-conditioning equipment for the plant, adjacent offices and for residences.

An important feature of the present invention is the ability to store heat in the heat transfer fluid system from a melting operation of the cupola when the hot gas withdrawn therefrom is at 1800° to 2200° F. and to reject heat when the system is idling, the afterburners are on, and the hot gas is at 500° to 1300° F. A typical operation consists of melting for 30 minutes and idling for 30 minutes for a total of 16 hours per day. The heat recovery system is operated as a storage system whereby the bulk heat transfer fluid temperature ranges from 400° to 1000° F. when using heat transfer salt. The lower temperature is determined by the lowest safe temperature to which the hot gas can be cooled with the higher temperature selected as the maximum allowable temperature for the heat transfer fluid. It will be appreciated that using an intermediate heat transfer fluid permits auxiliary firing with fuel oil reducing fuel gas and coke requirements.

Another feature of the present invention is the use of hot charging door air. The charging door is normally an opening in the side of the cupola which, for ease of operation, is always open and permits cold air to enter the cupola. It is proposed to add air, heated by the recovery system, at a point below the charging door or on either side of the charging door through one or more openings. Such hot air would reduce the amount of cold air which would have to enter the charging door since the hot air would prevent the smoke and gas generated in the lower section of the cupola from leaving the cupola through the charging door. The vertically rising smoke and gas would be pushed or induced away from the charging door by the hot charging door air which would be directed horizontally into the cupola.

For example, assuming a large cupola operating at 20,000 scfm blast air; 20,000 scfm charge door indraft, and at an 1800° F. stack gas temperature for 6000 hours per year, a heat recovery system of the present invention installed to cool the stack gas to 500° F. with recovered heat being used to reduce consumption of gas and coke having an average cost of $3 per million BTU, an annual saving would be realized of over $1,000,000.

The heat recovery system of the present invention greatly improves the design, operation and maintenance of pollution control system (i.e. wet scrubber, electrostatic precipitator, bag house or mechanical collector) associated with various processes, since there is realized a substantial reduction in gas volume and cooling.

Installation in an existing foundry cupolas having a wet scrubber system, the sensible cooling of the stack gas prior to quenching in the scrubber substantially reduces water consumption. This reduction in water evaporation greatly reduces the volume and weight of saturated gas which the system fan must handle. Thus, there is a 31% reduction in volume flow by cooling the gas from 500° to 1800° F., by heat recovery instead of direct spray water cooling.

The heat recovery system of the present invention has many advantages:

1. The high heat capacity of an intermediate heat transfer fluid system permits accumulation and storage of large amounts of heat. Reuse of the recovered energy can be scheduled to level peak loads or meet other requirements having usage patterns difference from those of the waste heat source.

2. The extremely high coefficient of heat transfer between the exchanger and heat transfer fluid results in an overall heat transfer rate much greater than that of a gas-to-air exchanger system. The heat transfer fluid film transfer coefficient is about 50 times higher than the air film transfer coefficient in gas-to-air heat exchangers. The heat transfer surface area required is therefore about one-half of that required for a gas-to-air exchanger of equal duty.

3. The high heat transfer coefficient described above maintains the exchanger surface temperature within a relatively few degrees of the heat transfer fluid temperature. In high temperature applications, the metal surfaces of the heat transfer fluid system exchanger may be 500 degrees cooler than the metal surfaces of a gas-to-air exchanger. This lower metal temperature contributes to economy of design and to dependability of operation. Standard materials of construction can be used for heat transfer fluid system exchangers instead of the high alloys required for gas-to-air exchangers.

4. The near equality of exchanger and heat transfer fluid temperatures coupled with the high heat capacity of the heat transfer fluid makes the exchanger surface relatively independent of rapid fluctuations in stack gas temperature. The heat transfer fluid system exchanger is therefore not subjected to the damaging metal temperature fluctuations common to gas-to-air exchangers.

5. The heat transfer fluid system offers considerable flexibility of choice regarding the manner and rate of re-use of the recovered heat. The heat can be used for process air preheating, for steam generation, for direct process heating, etc. Other waste heat recovery systems do not possess such flexibility.

6. Multiple waste heat sources, such as a number of cupolas in a large foundry, can be served by a single heat transfer fluid storage and circulating system resulting in substantial economies in the control, circulating, and re-use systems.

7. Molten salt is non-flammable and non-corrosive, and systems employing same may operate at atmospheric pressure plus static level. Salt is also thermally stable to 1000° F.

8. Utilizing salt dilution techniques (i.e. water concentration or dilution during operations shutdown or start-up) eliminate freeze-up problems during such start-up and shut-down operations.

While the present invention has been discussed with reference to the incorporation of a heat recovery system in combination with a cupola, it will be understood that such system may be used with any metallurgical, chemical, or refinery process and particularly useful with processes which produce hot, dirty gas containing fines which have to be separated in dust removal equipment before being exhausted to the atmosphere. Since prior to passage through dust removal equipment, the hot, dirty gas must be cooled to 400°–500° F., the process and apparatus of the present invention provides a particularly economically attractive alternate to presently practiced techniques.

While the invention has been described in connection with an exemplary embodiment thereof, it will be understood that many modifications will be apparent to those of ordinary skill in the art and that this application is intended to cover any adaptations or variations thereof. Therefore, it is manifestly intended that this invention be only limited by the claims and the equivalents thereof.

We claim:

1. An apparatus for recovering heat from an exhaust gas having a temperature of about 500° to 2500° F. produced during the operation of a cupola cycling between a melt mode and an idling mode which comprises:

a first heat exchanger means for passing said exhaust gas in indirect heat transfer relationship to an intermediate heat transfer medium to thereby cool said exhaust gas and heat said heat transfer medium;

a second heat exchanger means for passing at least a portion of said heated heat transfer medium in indirect heat transfer relationship to an air stream, said second heat exchanger including pipe means for passing said preheated air stream to said cupola as combustion air, blast air, and charge door air;

a first conduit means for passing said heated heat transfer medium from said first heat exchanger means to said second heat exchanger means;

a storage zone for receiving heat transfer medium from said second heat exchanger means and for passing heat transfer medium to said first heat exchanger means;

a second conduit means for passing said heat transfer medium from said second heat exchanger means to said storage zone;

a third conduit means for passing heat transfer medium to said first heat exchanger means from said storage zone; and pump means for passing said heat transfer medium through said heat exchanger means and said storage zone.

2. The apparatus of claim 1 wherein said second heat exchanger means includes conduit means for heating a fluid to be passed to said cupola during the operation thereof.

3. The apparatus of claim 1 wherein said storage tank includes conduit means for introducing a diluent during shut-down operation of said cupola.

4. The apparatus of claim 3 wherein said storage tank includes conduit means for withdrawing diluent during start-up operation of said cupola.

* * * * *

UNITED STATES PATENT AND TRADEMARK OFFICE

CERTIFICATE OF CORRECTION

PATENT NO. : 4,340,207

DATED : July 20, 1982

INVENTOR(S) : Bruhn, Alfred

It is certified that error appears in the above—identified patent and that said Letters Patent is hereby corrected as shown below:

On the title page, Assignee should read

-- American Hydrotherm Corporation --.

Signed and Sealed this

*Twelfth* Day of *October 1982*

[SEAL]

*Attest:*

GERALD J. MOSSINGHOFF

*Attesting Officer*

*Commissioner of Patents and Trademarks*